US009349508B2

(12) United States Patent
Nonen et al.

(10) Patent No.: US 9,349,508 B2
(45) Date of Patent: May 24, 2016

(54) MULTI-PAIR DIFFERENTIAL SIGNAL TRANSMISSION CABLE

(71) Applicant: Hitachi Metals, Ltd., Tokyo (JP)

(72) Inventors: Hideki Nonen, Mito (JP); Takahiro Sugiyama, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 116 days.

(21) Appl. No.: 14/149,614

(22) Filed: Jan. 7, 2014

(65) Prior Publication Data

US 2015/0000954 A1 Jan. 1, 2015

(30) Foreign Application Priority Data

Jun. 26, 2013 (JP) ..... 2013-134041

(51) Int. Cl.
*H01B 7/00* (2006.01)
*H01B 11/20* (2006.01)
*H01B 11/00* (2006.01)

(52) U.S. Cl.
CPC ..... *H01B 11/20* (2013.01); *H01B 11/002* (2013.01)

(58) Field of Classification Search
CPC ..... H01B 7/00; H01B 7/02; H01B 7/0208; H01B 7/0216; H01B 7/0225; H01B 7/295; H01B 7/0258; H01B 7/0275; H01B 7/0283; H01B 7/17; H01B 7/1855; H01B 7/28; H01B 7/366; H01B 11/00; H01B 11/002; H01B 11/005; H01B 11/02; H01B 11/04; H01B 11/06; H01B 11/08; H01B 11/085; H01B 11/10; H01B 11/1025; H01B 13/00; H01B 13/06
USPC ..... 174/102 R, 106 R, 107, 108, 109, 110 R, 174/113 R, 113 C, 112, 115, 116
See application file for complete search history.

(56) References Cited

U.S. PATENT DOCUMENTS

| | | | | | |
|---|---|---|---|---|---|
| 3,439,111 | A * | 4/1969 | Miracle et al. | ..... | 174/107 |
| 4,096,346 | A * | 6/1978 | Stine et al. | ..... | 174/36 |
| 5,144,098 | A * | 9/1992 | VanDeusen | ..... | 174/36 |
| 5,530,203 | A * | 6/1996 | Adams et al. | ..... | 174/36 |
| 5,767,442 | A * | 6/1998 | Eisenberg et al. | ..... | 174/36 |
| 6,010,788 | A * | 1/2000 | Kebabjian et al. | ..... | 428/381 |
| 6,403,887 | B1 * | 6/2002 | Kebabjian et al. | ..... | 174/110 R |
| 6,452,107 | B1 * | 9/2002 | Kebabjian | ..... | 174/113 R |

(Continued)

FOREIGN PATENT DOCUMENTS

| | | | | |
|---|---|---|---|---|
| JP | 2003-338224 A * | 11/2003 | ..... | H01B 11/02 |
| JP | 2004-087189 | 3/2004 | | |

(Continued)

OTHER PUBLICATIONS

United States Office Action dated Mar. 28, 2016 in U.S. Appl. No. 13/785,831.

*Primary Examiner* — William H Mayo, III
(74) *Attorney, Agent, or Firm* — McGinn IP Law Group, PLLC.

(57) ABSTRACT

A pair of second intervening members configured to hold a transverse cross-section of a first intervening member in a circular shape is disposed inside the first intervening member together with a first cable assembly. An overlap portion of each of differential signal transmission cables that form the first cable assembly and a second cable assembly is oriented toward a second shielding tape conductor.

20 Claims, 7 Drawing Sheets

(56) References Cited

U.S. PATENT DOCUMENTS

| | | | | |
|---|---|---|---|---|
| 6,462,268 | B1 * | 10/2002 | Hazy et al. | 174/36 |
| 6,566,606 | B1 * | 5/2003 | Hazy et al. | 174/113 R |
| 6,815,611 | B1 * | 11/2004 | Gareis | 174/36 |
| 7,479,601 | B1 * | 1/2009 | Cases et al. | 174/102 R |
| 7,790,981 | B2 | 9/2010 | Vaupotic | |
| 7,999,185 | B2 * | 8/2011 | Cases et al. | 174/113 R |
| 8,039,749 | B2 * | 10/2011 | Okano et al. | 174/113 R |
| 8,546,690 | B2 * | 10/2013 | Masakazu et al. | 174/103 |
| 2006/0048966 | A1 * | 3/2006 | Takahashi et al. | 174/108 |
| 2010/0025072 | A1 * | 2/2010 | Okano et al. | 174/115 |
| 2010/0065299 | A1 | 3/2010 | Liu | |
| 2011/0100682 | A1 * | 5/2011 | Nonen et al. | 174/254 |
| 2013/0248221 | A1 * | 9/2013 | Booth et al. | 174/103 |
| 2013/0333913 | A1 * | 12/2013 | Nonen et al. | 174/34 |
| 2014/0034352 | A1 * | 2/2014 | Sugiyama et al. | 174/107 |
| 2014/0102756 | A1 * | 4/2014 | Ishikawa et al. | 174/115 |
| 2014/0209343 | A1 | 7/2014 | Gundel | |

FOREIGN PATENT DOCUMENTS

| | | | | | |
|---|---|---|---|---|---|
| JP | 2004-087189 | A | * | 3/2004 | H01B 11/02 |
| JP | 2012-238468 | A | * | 12/2012 | H01B 11/06 |
| WO | WO2006/031633 | A1 | * | 3/2006 | H01B 11/06 |

* cited by examiner

MULTI-PAIR DIFFERENTIAL SIGNAL TRANSMISSION CABLE

The present application is based on Japanese patent application No. 2013-134041 filed on Jun. 26, 2013, the entire contents of which are incorporated herein by reference.

BACKGROUND OF THE INVENTION

1. Field of the Invention

The present invention relates to a multi-pair differential signal transmission cable formed by bundling together a plurality of differential signal transmission cables.

2. Description of the Related Art

Devices (e.g., servers, routers, and storage products) that deal with high-speed digital signals of several gigabits per second (Gbit/s) or more have adopted a differential interface standard, such as the low-voltage differential signaling (LVDS). Between devices or between circuit boards within a device, differential signals are transmitted through a differential signal transmission cable. Differential signals are characterized by having a high resistance to external noise while realizing a low-voltage system power supply.

A differential signal transmission cable includes a pair of signal line conductors, which are configured to transmit a plus-side signal and a minus-side signal having a phase difference of 180 degrees. A potential difference between these two signals is represented by a signal level. For example, if the potential difference is plus, a signal level "High" is recognized on a receiving side, and if the potential difference is minus, a signal level "Low" is recognized on the receiving side.

With a recent increase in transmission capacity, multi-pair differential signal transmission cables have come into use, which are each formed by bundling together a plurality of differential signal transmission cables. For example, Japanese Unexamined Patent Application Publication No. 2004-087189 (see, e.g., FIGS. 2 and 6) discloses a multi-pair differential signal transmission cable capable of transmitting many differential signals. In this document, a transmission cable (differential signal transmission cable) is disclosed, which includes a pair of insulated lines each formed by covering a signal line (signal line conductor) with an insulating layer (insulator), and a drain line. The transmission cable is obtained by covering the insulated lines and the drain line with a shielding material (shielding tape conductor), and covering the shielding material with a cushioning material. A transmission cable assembly (multi-pair differential signal transmission cable) is formed by bundling together a plurality of transmission cables with a shielding tape, a braided shield, and a jacket layer.

SUMMARY OF THE INVENTION

However, in the multi-pair differential signal transmission cable disclosed in the document described above, the efficiency of signal transmission may be degraded by crosstalk between differential signal transmission cables.

Here, the crosstalk is caused by transfer of electromagnetic energy from a differential signal transmission cable (aggressor) not contributing to signal transmission to a differential signal transmission cable (victim) contributing to signal transmission. The transfer of electromagnetic energy is induced mainly by a common mode component having an electric field spreading over a large area.

Typically, a multi-pair differential signal transmission cable is configured to prevent the spreading of an electric field (i.e., leakage of common mode energy) by shielding each differential signal transmission cable with a shielding tape conductor. In practice, however, current (common mode current) flowing through the shielding tape conductor generates a magnetic field, and the resulting common mode component also causes the occurrence of crosstalk. The amount of energy of the common mode component is determined by the common mode current flowing along the outer surface of the shielding tape conductor.

As described above, crosstalk is caused by transfer of common mode energy between differential signal transmission cables, and common mode current flowing through the shielding tape conductor of each differential signal transmission cable. The common mode current is also generated by electrical imbalance between differential signal transmission cables. Specifically, the common mode current is generated when, for example, the orientation of each differential signal transmission cable is changed or the insulator is flattened and deformed while the differential signal transmission cables are being twisted together to manufacture the multi-pair differential signal transmission cable.

An object of the present invention is to provide a multi-pair differential signal transmission cable capable of suppressing the occurrence of crosstalk.

According to an exemplary aspect of the present invention, a multi-pair differential signal transmission cable formed by bundling together a plurality of differential signal transmission cables, each including a pair of signal line conductors, an insulator disposed around the signal line conductors, a first shielding tape conductor longitudinally lapped around the insulator, and an overlap portion formed by the first shielding tape conductor and extending in a longitudinal direction of the signal line conductors, includes a first cable assembly formed by more than one of the plurality of differential signal transmission cables; a first intervening member configured to cover a periphery of the first cable assembly; a pair of second intervening members disposed inside the first intervening member together with the first cable assembly, the second intervening members being configured to hold a transverse cross-section of the first intervening member in a circular shape; a second cable assembly disposed around the first intervening member, the second cable assembly being formed by arranging more than one of the plurality of differential signal transmission cables in a circumferential direction of the first intervening member; and a covering member configured to cover a periphery of the second cable assembly. The overlap portion of each of the differential signal transmission cables is oriented toward the covering member.

According to another exemplary aspect of the present invention, the overlap portion may be located on a vertical line passing through a center of a line segment that connects axial centers of the signal line conductors.

According to another exemplary aspect of the present invention, the signal line conductors may be covered together by the insulator, and a periphery of the insulator may be closely covered by the first shielding tape conductor.

According to another exemplary aspect of the present invention, a transverse cross-section of the insulator may be in the shape of a track having a pair of linear portions and a pair of arc portions located between the linear portions, the linear portions extending in a direction in which the signal line conductors are arranged.

According to another exemplary aspect of the present invention, a transverse cross-section of the insulator may be in the shape of an ellipse having a major axis and a minor axis orthogonal to the major axis, the major axis extending in a direction in which the signal line conductors are arranged.

According to another exemplary aspect of the present invention, the first cable assembly may be formed by two differential signal transmission cables, and the second cable assembly may be formed by six differential signal transmission cables.

According to another exemplary aspect of the present invention, the covering member may be formed by a second shielding tape conductor, a braided wire that covers a periphery of the second shielding tape conductor, and a jacket that covers a periphery of the braided wire.

According to the present invention, the second intervening members that hold the transverse cross-section of the first intervening member in a circular shape are disposed inside the first intervening member together with the first cable assembly, and the overlap portion of each of the differential signal transmission cables that form the first cable assembly and the second cable assembly is oriented toward the covering member.

Thus, even when the plurality of differential signal transmission cables are twisted and bundled together, since the transverse cross-section of the first intervening member is held in a circular shape by the second intervening members, it is possible to reduce changes in orientation of each of the differential signal transmission cables, flattening and deformation of the insulator, and occurrence of electrical imbalance.

Since each of the overlap portions where a large amount of common mode current flows is oriented toward the covering member, it is possible to suppress leakage of common mode energy toward the inside of the multi-pair differential signal transmission cable.

Therefore, a multi-pair differential signal transmission cable capable of suppressing the occurrence of crosstalk can be obtained.

BRIEF DESCRIPTION OF THE DRAWINGS

The foregoing and other exemplary purposes, aspects and advantages will be better understood from the following detailed description of the invention with reference to the drawings, in which.

DESCRIPTION OF THE PREFERRED EMBODIMENTS

A first embodiment of the present invention will now be described in detail with reference to the drawings.

Figure 1:
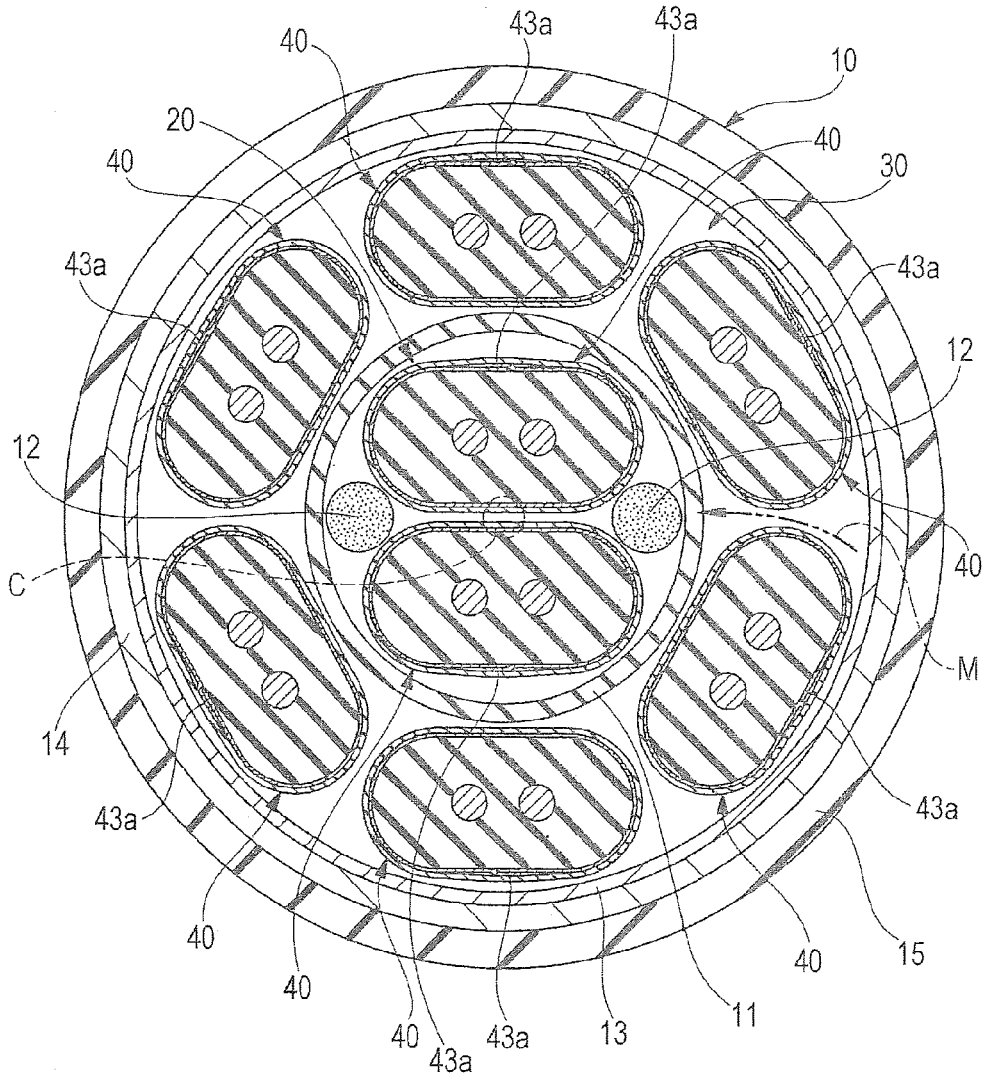
FIG. 1 is a transverse cross-sectional view of a multi-pair differential signal transmission cable according to a first embodiment.
Figure 2A:
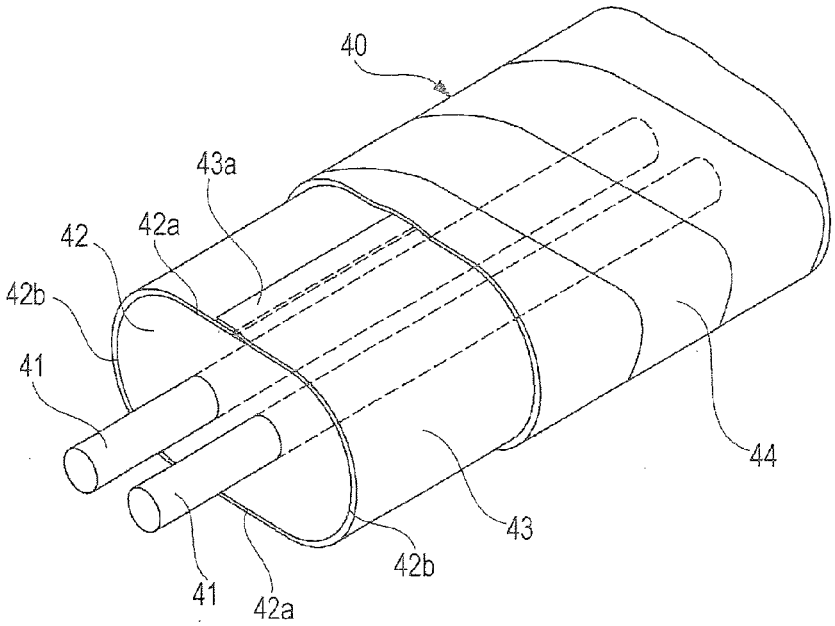
FIG. 2A is a perspective view of a differential signal transmission cable according to the first embodiment.
Figure 2B:
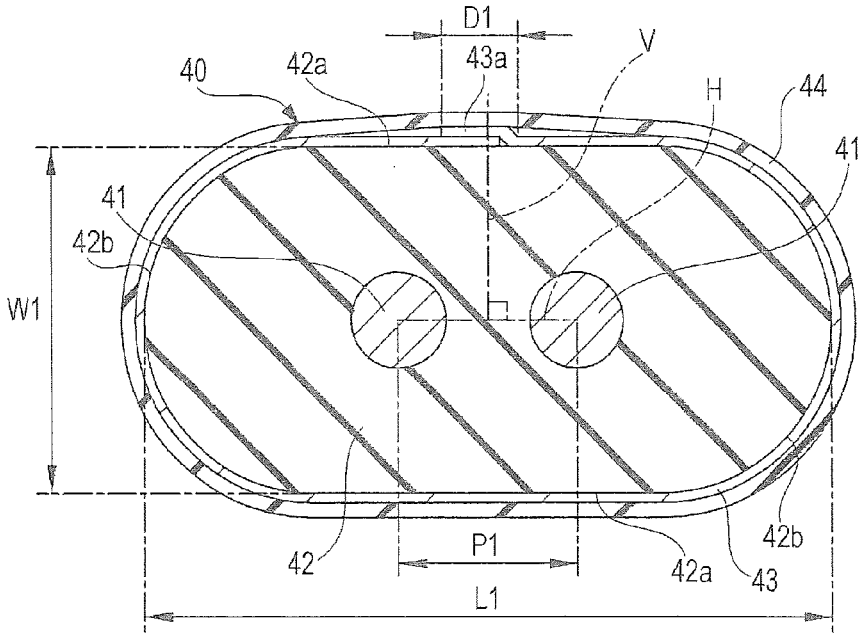
FIG. 2B is a cross-sectional view of the differential signal transmission cable according to the first embodiment.

FIG. 1 is a transverse cross-sectional view of a multi-pair differential signal transmission cable according to the first embodiment, FIG. 2A is a perspective view of a differential signal transmission cable according to the first embodiment, and FIG. 2B is a cross-sectional view of the differential signal transmission cable according to the first embodiment.

As illustrated in FIG. 1, a multi-pair differential signal transmission cable 10 according to the first embodiment is circular in transverse cross-section. The multi-pair differential signal transmission cable 10 includes a first cable assembly 20 disposed around an axial center C (indicated by a dashed circle in FIG. 1), and a second cable assembly 30 disposed around the first cable assembly 20.

The first cable assembly 20 is formed by twisting two differential signal transmission cables 40. The second cable assembly 30 is formed by arranging six differential signal transmission cables 40 around the first cable assembly 20 in the circumferential direction and twisting them. Thus, the multi-pair differential signal transmission cable 10 is formed by twisting and bundling a total of eight differential signal transmission cables 40.

Before a detailed description of the multi-pair differential signal transmission cable 10, a structure of each of the differential signal transmission cables 40 forming the multi-pair differential signal transmission cable 10 will be described in detail.

As illustrated in FIGS. 2A and 2B, each differential signal transmission cable 40 includes a pair of signal line conductors 41. A plus-side signal (differential signal) is transmitted through one of the signal line conductors 41, and a minus-side signal (differential signal) is transmitted through the other of the signal line conductors 41. Each of the signal line conductors 41 is formed, for example, by a silver-plated annealed copper wire. This provides advantages for use in high-speed transmission. Alternatively, an inexpensive tinned annealed copper wire may be used where appropriate.

The signal line conductors 41 are covered together by a common insulator 42. To make the differential signal transmission cable 40 flexible, the insulator 42 is made, for example, of solid polyethylene containing no air bubbles. A transverse cross-section of the insulator 42 is in the shape of a track which is substantially the same as that in an athletic field. Specifically, the transverse cross-section of the insulator 42 has a pair of linear portions 42*a* of equal length extending in a direction in which the signal line conductors 41 are arranged (hereinafter may be referred to as the direction of arrangement of the signal line conductors 41), and a pair of arc portions 42*b* located between the linear portions 42*a*.

The insulator 42 holds the signal line conductors 41 to secure an intercentral distance P1 (e.g., 0.572 mm) which is a distance between axial centers of the signal line conductors 41. A length dimension of the insulator 42 along the direction of arrangement of the signal line conductors 41 is set to L1 (e.g., 1.92 mm), and a width dimension of the insulator 42 along a direction orthogonal to the direction of arrangement of the signal line conductors 41 is set to W1 (e.g., 0.96 mm) ($L1=2\cdot W1$). With these dimensions of the insulator 42, the transverse cross-section of the differential signal transmission cable 40 has an aspect ratio of "2:1". Therefore, as illustrated in FIG. 1, two differential signal transmission cables 40 stacked together are substantially square in transverse cross-section.

The periphery of the insulator 42 is closely covered by longitudinal lapping (also referred to as cigarette lapping) of a first shielding tape conductor 43 for suppressing the effect of external noise. The first shielding tape conductor 43 is formed, for example, by a sheet of copper foil. End portions of the first shielding tape conductor 43 along the lapping direction overlap each other to form an overlap portion 43*a*. The overlap portion 43*a* is formed by the first shielding tape conductor 43 and extends in the longitudinal direction of the differential signal transmission cable 40.

The length dimension of the overlap portion 43*a* along the direction of arrangement of the signal line conductors 41 is set to a length dimension D1 smaller than the intercentral distance P1 of the signal line conductors 41 (D1<P1). The overlap portion 43*a* is located on a vertical line V passing through the center of a line segment H that connects the axial centers of the signal line conductors 41. This makes the distances between the overlap portion 43*a* and each of the signal line conductors 41 substantially the same, and reduces deterioration of electrical characteristics of the differential signal transmission cable 40.

The first shielding tape conductor 43 may be made of other metal foil instead of copper foil, or may be a braided wire formed by braiding thin metal wires, such as annealed copper wires.

An insulating tape 44 is wound around the first shielding tape conductor 43. The insulating tape 44 serves as a protective outer sheath for protecting the differential signal transmission cable 40. For example, an insulating tape made of heat resistant polyvinyl chloride (PVC) is used as the insulating tape 44.

As illustrated in FIG. 1, the plurality of differential signal transmission cables 40 that form the first cable assembly 20 and the second cable assembly 30 are each positioned such that the overlap portion 43*a* faces outward in the radial direction of the multi-pair differential signal transmission cable 10. In other words, each of the differential signal transmission cables 40 is positioned with its backside toward the axial center C of the multi-pair differential signal transmission cable 10.

A first intervening member 11 having a substantially cylindrical shape is disposed between the first cable assembly 20 and the second cable assembly 30. The first intervening member 11 is disposed to cover the periphery of the first cable assembly 20. For example, the first intervening member 11 is formed by an insulating tape made of heat resistant PVC.

Together with the first cable assembly 20, a pair of second intervening members 12 is disposed inside the first intervening member 11. The second intervening members 12 are disposed on a side opposite the overlap portion 43*a* of each of the differential signal transmission cables 40 forming the first cable assembly 20, and at both ends in the direction of arrangement of the signal line conductors 41 (see FIGS. 2A and 2B). The second intervening members 12 are twisted with the differential signal transmission cables 40 to manufacture the first cable assembly 20.

The second intervening members 12 are disposed at predetermined positions described above. This enables the transverse cross-section of the first intervening member 11 to be held in a circular shape as illustrated in FIG. 1. In the first cable assembly 20, as described above, the two differential signal transmission cables 40 stacked together are substantially square in transverse cross-section. By adding the pair of second intervening members 12 to the two differential signal transmission cables 40 stacked together, the outer shape of the first cable assembly 20 is formed into a substantially circular shape. Paper or threads formed by twisting fine fibrous materials, or a cushioning material, such as a foamed material or rubber, may be used as the second intervening members 12.

The second cable assembly 30 is disposed around the first extending portion 11. The second cable assembly 30 is formed by arranging six differential signal transmission cables 40 at regular intervals (60° intervals) in the circumferential direction of the first intervening member 11. The differential signal transmission cables 40 that form the second cable assembly 30 are pressed toward the first intervening member 11 and twisted by a second shielding tape conductor (covering member) 13 wound to cover the periphery of the second cable assembly 30. Like the first shielding tape conductor 43 (see FIGS. 2A and 2B) described above, the second shielding tape conductor 13 is formed, for example, by a sheet of copper foil. Again, the second shielding tape conductor 13 may be made of other metal foil instead of copper foil, or may be a braided wire formed by braiding thin metal wires, such as annealed copper wires.

In the process of manufacturing the multi-pair differential signal transmission cable 10, the differential signal transmission cables 40 forming the second cable assembly 30 are pressed toward the first intervening member 11 when the second shielding tape conductor 13 is wound around the differential signal transmission cables 40. As indicated by a dashed arrow M in FIG. 1, the pressing force attempts to tilt some of the differential signal transmission cables 40. However, as described above, the first intervening member 11 is held in a circular shape by the second intervening members 12 disposed inside the first intervening member 11. This makes it less likely that the differential signal transmission cables 40 forming the second cable assembly 30 will tilt and change their orientations.

Thus, as illustrated in FIG. 1, all of the eight differential signal transmission cables 40 can be regularly and neatly arranged without tilt. Therefore, it is less likely that the insulator 42 (see FIGS. 2A and 2B) of each differential signal transmission cable 40 will be partially deformed by a large load applied thereto, and less likely that the first shielding tape conductor 43 will be peeled from the insulator 42. Particularly in the differential signal transmission cable 40 having the pair of linear portions 42*a* such as that illustrated in FIGS. 2A and 2B, a deformation of the insulator 42 may directly cause the first shielding tape conductor 43 to be peeled off at each of the linear portions 42*a*. Since this may lead to deterioration of electrical characteristics, it is desirable to reduce deformation of the insulator 42.

A braided wire 14 (see FIG. 1) formed by braiding thin metal wires, such as annealed copper wires, is disposed around the second shielding tape conductor 13. A jacket (sheath) 15 made, for example, of heat resistant PVC is disposed around the braided wire 14. Like the second shielding tape conductor 13, the braided wire 14 and the jacket 15 form the covering member of the present invention.

As illustrated in FIGS. 2A and 2B, the overlap portion 43*a* formed by the first shielding tape conductor 43 is provided on one side of the differential signal transmission cable 40 along its transverse direction, but is not provided on the other side of the differential signal transmission cable 40 along its transverse direction. Analysis of leakage of electromagnetic energy around the differential signal transmission cable 40 showed that the amount of leakage is larger on the side with the overlap portion 43*a* than on the opposite side. The result of the analysis will now be described.

Figure 3:
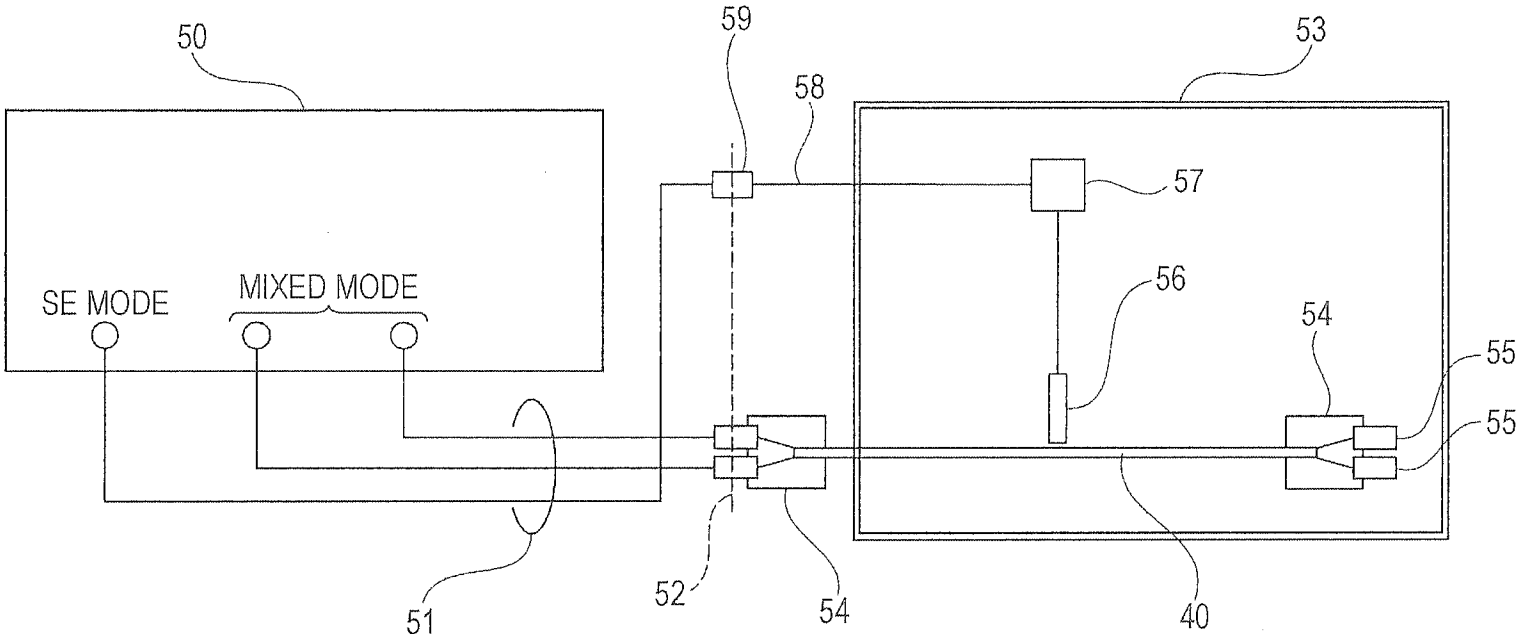
FIG. 3 schematically illustrates a measuring system that analyzes magnetic field strengths in the vicinity of the differential signal transmission cable.
Figure 4:
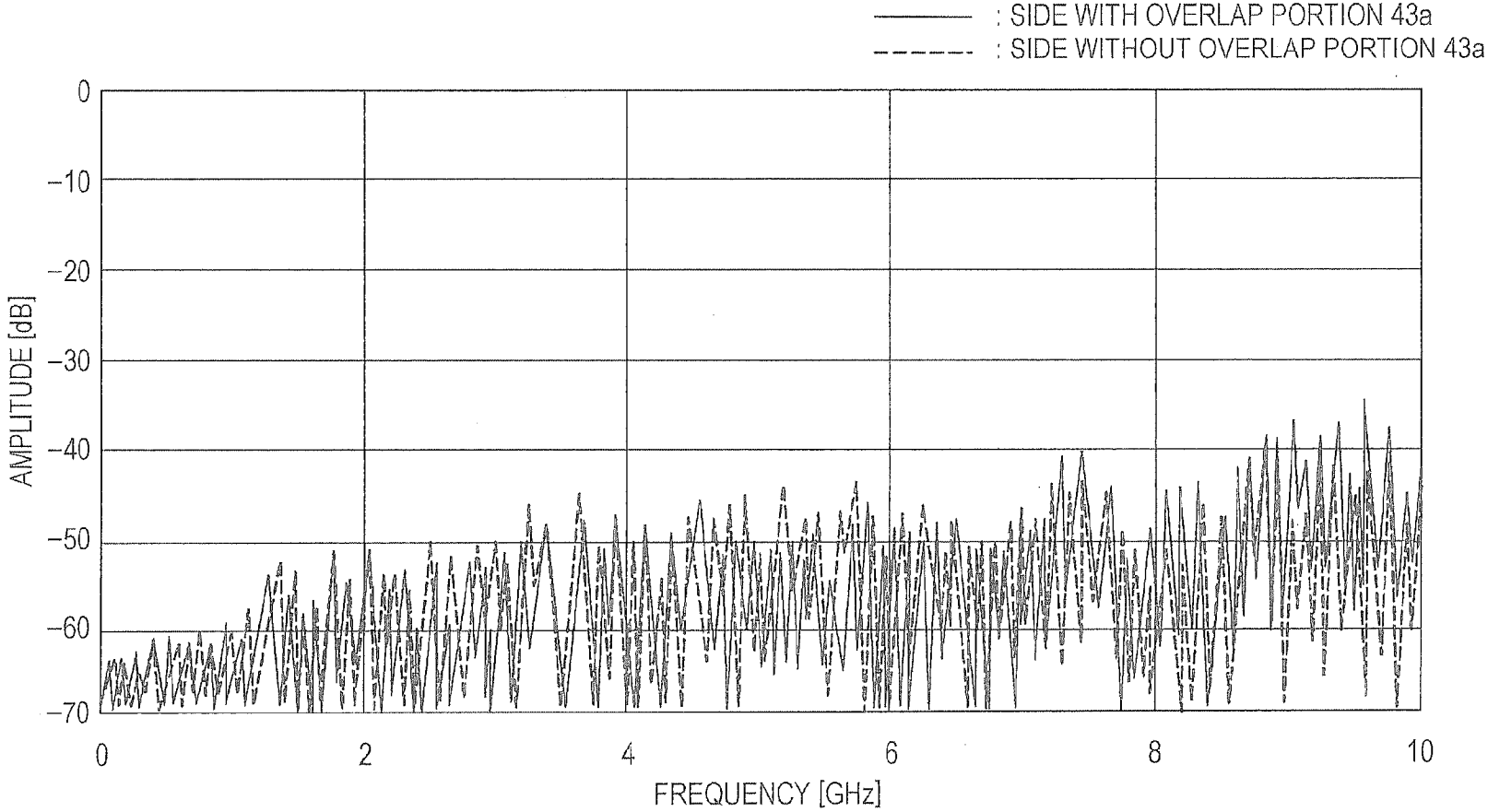
FIG. 4 is a graph showing a spectrum of magnetic field strengths obtained in response to input of a differential mode signal to the differential signal transmission cable.
Figure 5:
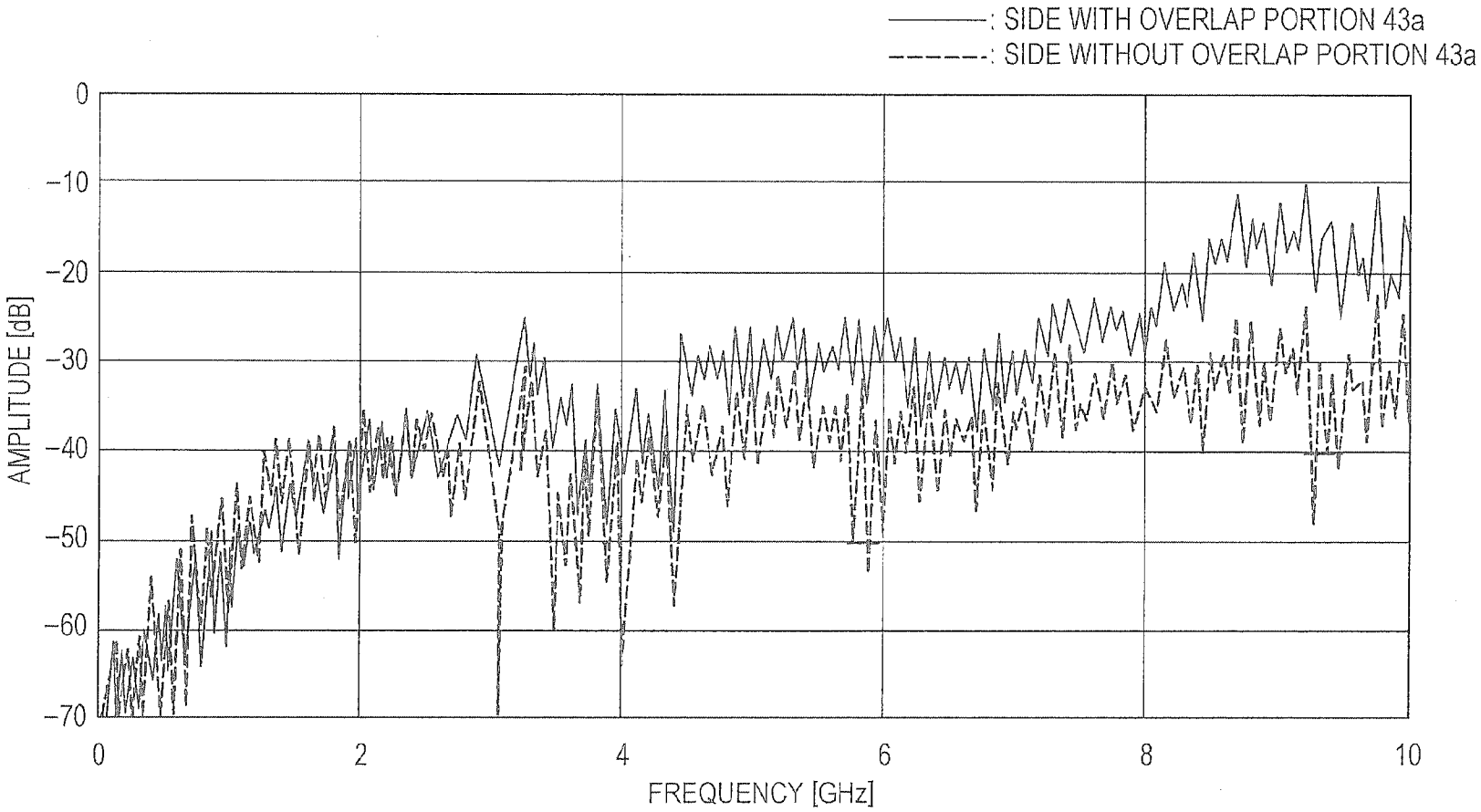
FIG. 5 is a graph showing a spectrum of magnetic field strengths obtained in response to input of a common mode signal to the differential signal transmission cable.

FIG. 3 schematically illustrates a measuring system that analyzes magnetic field strengths in the vicinity of a differential signal transmission cable. FIG. 4 is a graph showing a spectrum of magnetic field strengths obtained in response to input of a differential mode signal to the differential signal transmission cable. FIG. 5 is a graph showing a spectrum of magnetic field strengths obtained in response to input of a common mode signal to the differential signal transmission cable.

FIG. 3 illustrates a measuring system in which calibration is performed such that end portions of a plurality of cables 51 connected to a network analyzer 50 coincide with a calibration plane 52. As illustrated, the measuring system includes an electromagnetic interference (EMI) measuring device 53. In the measuring system, a signal propagation mode defined by mixed mode signals (i.e., by a differential mode signal and a common mode signal) is input through a pair of cable-end handling jigs 54 to the differential signal transmission cable 40 which is an object to be measured. In the EMI measuring device 53, terminators 55 apply non-reflective processing to the differential signal transmission cable 40. The application of non-reflective processing can suppress undesired reflection signals which may cause noise, and can give a highly accurate result of analysis.

Common mode current, which may cause crosstalk, flows along the surface of the first shielding tape conductor 43 (see FIGS. 2A and 2B) that forms the differential signal transmission cable 40. Therefore, a magnetic field probe (magnetic field detector) 56 is placed near the surface of the differential signal transmission cable 40 to detect a magnetic field radiating from the differential signal transmission cable 40. A magnetic field signal detected by the magnetic field probe 56, that is, a common-mode current component is amplified by a preamplifier 57, transmitted through a cable 58, a sub-miniature type A (SMA) connector 59, and the cable 51, and measured as a single-end mode signal by the network analyzer 50.

FIG. 4 shows a spectrum of magnetic field strengths obtained in response to input of a differential mode signal (odd mode signal) to the differential signal transmission cable 40. That is, FIG. 4 is a graph showing a common-mode current component generated from the differential signal transmission cable 40 in response to input of a differential mode signal to the differential signal transmission cable 40 in the measuring system illustrated in FIG. 3.

FIG. 5 shows a spectrum of magnetic field strengths obtained in response to input of a common mode signal (even mode signal) to the differential signal transmission cable 40. That is, FIG. 5 is a graph showing a common-mode current component generated from the differential signal transmission cable 40 in response to input of a common mode signal to the differential signal transmission cable 40 in the measuring system illustrated in FIG. 3.

Referring to FIG. 4, the result of the analysis for the input of a differential mode signal shows that there is little difference in common-mode current component between the case of bringing the magnetic field probe 56 close to the surface on the side with the overlap portion 43*a* and the case of bringing the magnetic field probe 56 close to the surface on the side without the overlap portion 43*a*.

Referring to FIG. 5, on the other hand, the result of the analysis for the input of a common mode signal shows that the common-mode current component is greater in the case of bringing the magnetic field probe 56 close to the surface on the side with the overlap portion 43*a* than in the case of bringing the magnetic field probe 56 close to the surface on the side without the overlap portion 43*a*. This indicates that leakage of electromagnetic energy from the side with the overlap portion 43*a* is larger than that from the side without the overlap portion 43*a*. As shown, this tendency becomes more pronounced as the frequency increases (in the range of 5 GHz and higher, particularly 8 GHz and higher).

That is, the analysis shows that in the multi-pair differential signal transmission cable 10 capable of transmitting high-speed digital signals of several Gbit/s or more, arranging the differential signal transmission cables 40 regularly and neatly, with the overlap portions 43*a* facing outward in the radial direction of the multi-pair differential signal transmission cable 10, is an important design element for reducing crosstalk in the multi-pair differential signal transmission cable 10.

As described in detail above, in the multi-pair differential signal transmission cable 10 according to the first embodiment, the second intervening members 12 that hold the transverse cross-section of the first intervening member 11 in a circular shape are disposed inside the first intervening member 11 together with the first cable assembly 20, and the overlap portion 43*a* of each of the differential signal transmission cables 40 that form the first cable assembly 20 and the second cable assembly 30 is oriented toward the second shielding tape conductor 13.

Thus, even when the plurality of differential signal transmission cables 40 are twisted and bundled together, since the transverse cross-section of the first intervening member 11 is held in a circular shape by the second intervening members 12, it is possible to reduce changes in orientation of each of the differential signal transmission cables 40, flattening and deformation of the insulator 42, and occurrence of electrical imbalance.

Since each of the overlap portions 43*a* where a large amount of common mode current flows is oriented toward the second shielding tape conductor 13, it is possible to suppress leakage of common mode energy toward the inside of the multi-pair differential signal transmission cable 10.

Therefore, the multi-pair differential signal transmission cable 10 capable of suppressing the occurrence of crosstalk can be obtained.

Since leakage of common mode energy to other differential signal transmission cables 40 can be suppressed, it is possible to prevent interference of common mode energy between adjacent differential signal transmission cables 40 without increasing the physical distance between the differential signal transmission cables 40. Thus, it is possible to reduce the diameter of the multi-pair differential signal transmission cable 10 and make the multi-pair differential signal transmission cable 10 smaller.

A second embodiment of the present invention will now be described in detail with reference to the drawings. Note that parts having the same functions as those of the first embodiment are given the same reference numerals, and their detailed description will be omitted.

Figure 6A:
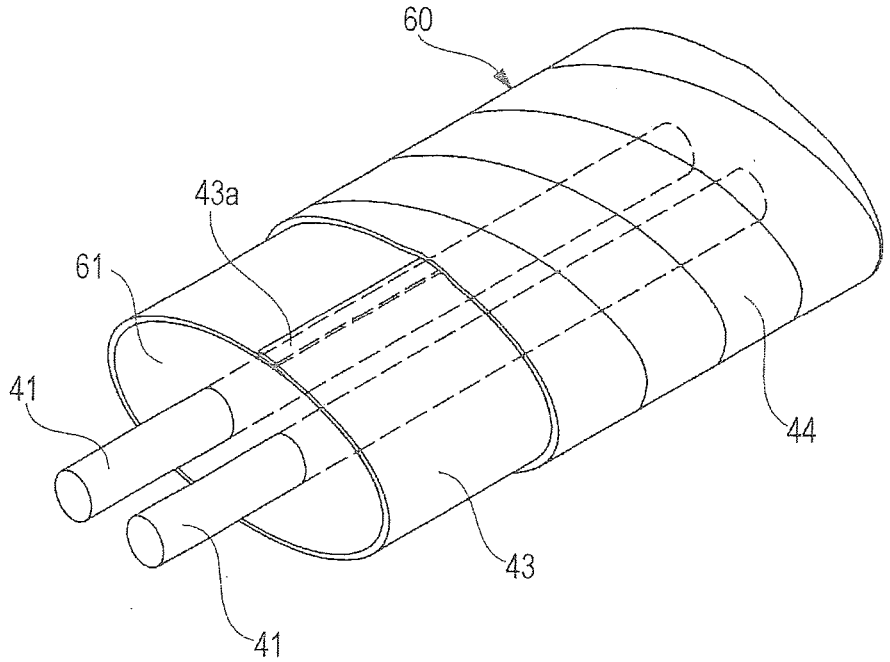
FIG. 6A is a perspective view of a differential signal transmission cable according to a second embodiment.
Figure 6B:
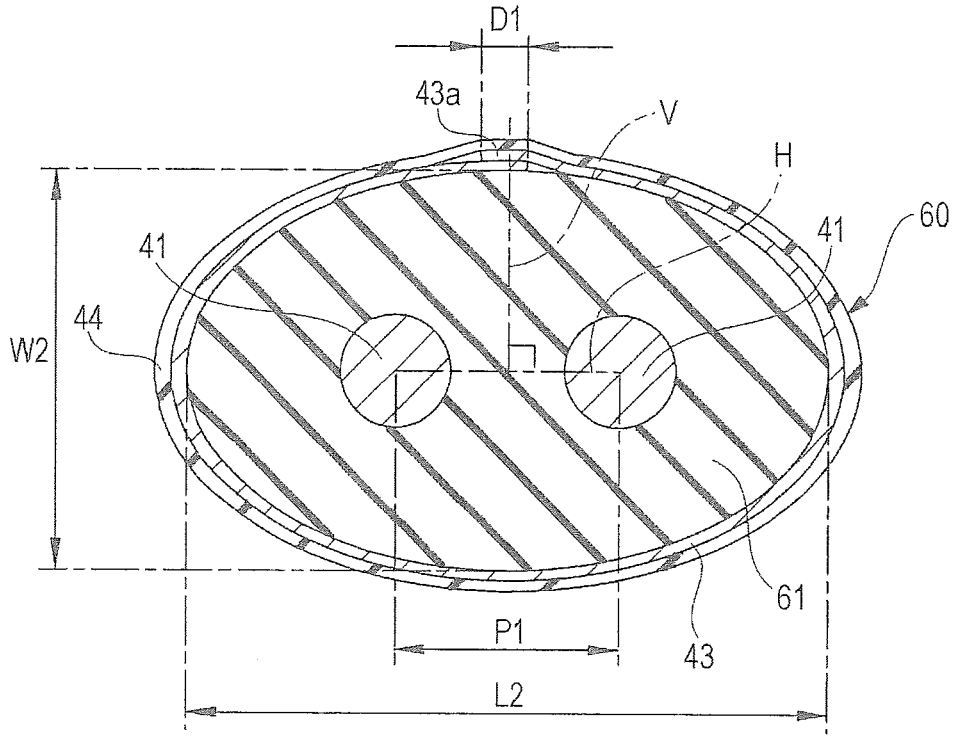
FIG. 6B is a cross-sectional view of the differential signal transmission cable according to the second embodiment.

FIG. 6A is a perspective view of a differential signal transmission cable according to the second embodiment, and FIG. 6B is a cross-sectional view of the differential signal transmission cable according to the second embodiment.

As illustrated in FIGS. 6A and 6B, a differential signal transmission cable 60 that forms a multi-pair differential signal transmission cable according to the second embodiment differs from the differential signal transmission cable 40 according to the first embodiment (see FIGS. 2A and 2B) only in terms of the transverse cross-sectional shape of an insulator 61. Specifically, the transverse cross-section of the insulator 61 is in the shape of an ellipse having a major axis with a length dimension L2 in the direction of arrangement of the signal line conductors 41 and a minor axis with a length dimension W2 (L2>W2), the minor axis being orthogonal to the major axis. The insulator 61 is also made of solid polyethylene containing no air bubbles.

The second embodiment configured as described above has a functional effect similar to that of the first embodiment. In the second embodiment, the first shielding tape conductor 43 is longitudinally lapped around the insulator 61 which is elliptical in transverse cross-section. Therefore, as compared to the first embodiment where the insulator 42 has the pair of linear portions 42*a* (see FIGS. 2A and 2B), the first shielding tape conductor 43 is less likely to be peeled from the insulator 61 by a partial external load, and a gap is less likely to be created between the insulator 61 and the first shielding tape conductor 43.

A third embodiment of the present invention will now be described in detail with reference to the drawings. Note that parts having the same functions as those of the second embodiment are given the same reference numerals, and their detailed description will be omitted.

Figure 7A:
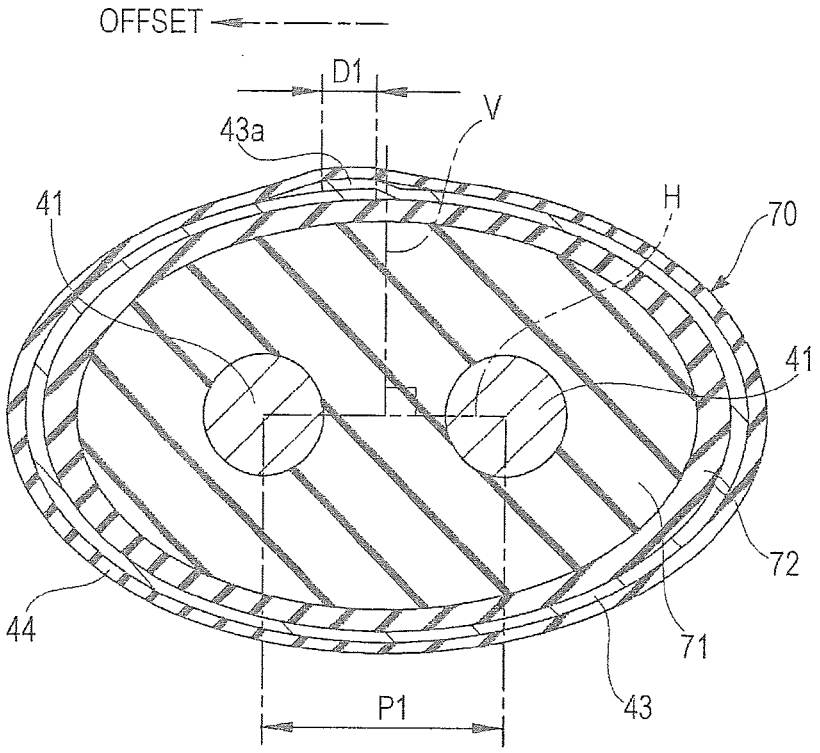
FIG. 7A is a cross-sectional view of a differential signal transmission cable according to a third embodiment.

FIG. 7A is a cross-sectional view of a differential signal transmission cable according to the third embodiment.

As illustrated in FIG. 7A, a differential signal transmission cable 70 that forms a multi-pair differential signal transmission cable according to the third embodiment differs from the differential signal transmission cable 60 of the second embodiment in that the differential signal transmission cable 70 includes an insulator 71 made of foamed polyethylene containing air bubbles, and an insulating skin layer 72 between the insulator 71 and the first shielding tape conductor 43. The insulating skin layer 72 is made of an insulating material, such as polytetrafluoroethylene (PTFE), and has a substantially cylindrical shape. For example, during extrusion molding of the insulator 71, the insulating skin layer 72 holds the insulator 71 so as to prevent deformation of the insulator 71 which is soft and has not yet hardened.

The third embodiment also differs from the second embodiment in that, as indicated by a dot-and-dash arrow in FIG. 7A, the overlap portion 43*a* of the first shielding tape conductor 43 is offset by a predetermined amount from the vertical line V. The amount of offset of the overlap portion 43*a* from the vertical line V is set to be sufficiently smaller than the intercentral distance P1 of the signal line conductors 41. Therefore, the offset does not cause any negative effect, such as crosstalk.

The third embodiment configured as described above has a functional effect similar to that of the second embodiment. Since the insulator 71 is made of foamed polyethylene in the third embodiment, the dielectric constant of the insulator 71 can be reduced. Thus, it is possible to reduce a decrease in transmission speed, and provide the differential signal transmission cable 70 suitable for high-speed transmission. As compared to the insulator 61 (see FIGS. 6A and 6B) which is solid in the second embodiment, the insulator 71 can be narrowed without sacrificing transmission efficiency, and the differential signal transmission cable 70 can be made more compact.

A fourth embodiment of the present invention will now be described in detail with reference to the drawings. Note that parts having the same functions as those of the first embodiment are given the same reference numerals, and their detailed description will be omitted.

Figure 7B:
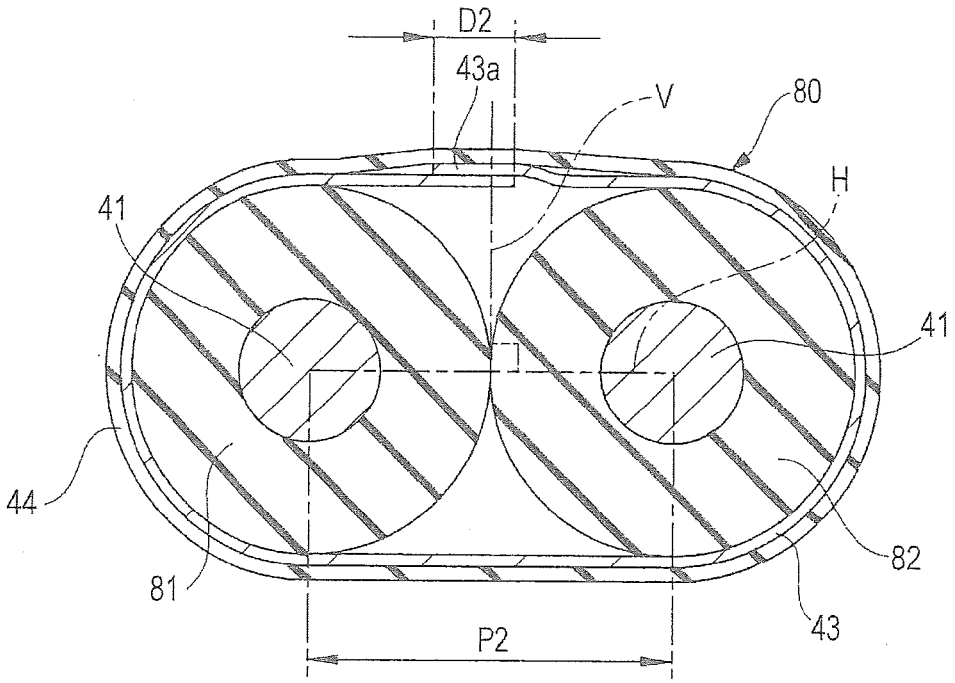
FIG. 7B is a cross-sectional view of a differential signal transmission cable according to a fourth embodiment.

FIG. 7B is a cross-sectional view of a differential signal transmission cable according to the fourth embodiment.

As illustrated in FIG. 7B, a differential signal transmission cable 80 that forms a multi-pair differential signal transmission cable according to the fourth embodiment differs from the differential signal transmission cable 40 of the first embodiment in that the signal line conductors 41 are individually covered with respective insulators 81 and 82. This makes an intercentral distance P2, which is a distance between the axial centers of the signal line conductors 41, greater than the intercentral distance P1 in the first to third embodiments described above (P2>P1).

In the fourth embodiment, a length dimension D2 of the overlap portion 43*a* of the first shielding tape conductor 43 along the direction of arrangement of the signal line conductors 41 is set to be greater than the length dimension D1 in the first to third embodiments described above (D2>D1). To prevent a large amount of common mode current from flowing in the overlap portion 43*a*, it is preferable that the length dimension of the overlap portion 43*a* along the direction of arrangement of the signal line conductors 41 be minimized, to the extent of not affecting the manufacture.

The present invention is not limited to the embodiments described above, and it is obvious that various changes may be made to the present invention without departing from the scope of the present invention. For example, although the embodiments described above illustrate the configuration in which the first cable assembly 20 is formed by two differential signal transmission cables and the second cable assembly 30 is formed by six differential signal transmission cables, the present invention is not limited to this. Depending on the specifications required for the multi-pair differential signal transmission cable, for example, the first cable assembly 20 may be formed by three differential signal transmission cables and the second cable assembly 30 may be formed by seven differential signal transmission cables. That is, the number of differential signal transmission cables may be set to an odd number or any number.

Although the signal line conductors 41 are silver-plated in the embodiments described above, the present invention is not limited to this, and non-plated signal line conductors may be used instead. This can reduce the cost of manufacturing the multi-pair differential signal transmission cable.

Although the second intervening members 12 are circular in transverse cross-section in the embodiments described above, the present invention is not limited to this. For example, the transverse cross-section of each second intervening member 12 may be in the shape of a fan that fits the inside shape (arc shape) of the first intervening member 11. This makes it possible to hold the transverse cross-section of the first intervening member 11 in a circular shape with more accuracy.

Although the embodiments described above illustrate the multi-pair differential signal transmission cable including the first cable assembly 20 and the second cable assembly 30, the present invention is not limited to this. For example, between the second cable assembly 30 and the second shielding tape conductor 13, there may be third, fourth, fifth, and other cable assemblies each formed by a plurality of differential signal transmission cables 40. In this case, the differential signal transmission cables 40 forming each of the cable assemblies are arranged, with the overlap portions 43*a* facing outward in the radial direction of the multi-pair differential signal transmission cable.

What is claimed is:

1. A multi-pair differential signal transmission cable formed by bundling together a plurality of differential signal transmission cables, each including:

a pair of signal line conductors;

an insulator disposed around the signal line conductors;

a first shielding tape conductor longitudinally lapped around the insulator;

an overlap portion formed by the first shielding tape conductor and extending in a longitudinal direction of the signal line conductors; and an insulating tape wound around the first shielding tape conductor, the multi-pair differential signal transmission cable comprising:

a first cable assembly formed by more than one of the plurality of differential signal transmission cables;

a first intervening member configured to cover a periphery of the first cable assembly;

a second intervening member disposed inside the first intervening member together with the first cable assembly, the second intervening member being configured to hold a transverse cross-section of the first intervening member in a circular shape;

a second cable assembly disposed around the first intervening member, the second cable assembly being formed by arranging more than one of the plurality of differential signal transmission cables in a circumferential direction of the first intervening member; and a covering member configured to cover a periphery of the second cable assembly, wherein the overlap portion of each of the differential signal transmission cables is oriented toward the covering member, and wherein the second intervening member is disposed outside the differential signal transmission cables of the first cable assembly.

2. The multi-pair differential signal transmission cable according to claim 1, wherein the overlap portion is located on a vertical line passing through a center of a line segment that connects axial centers of the signal line conductors.

3. The multi-pair differential signal transmission cable according to claim 1, wherein the signal line conductors are covered together by the insulator, and a periphery of the insulator is closely covered by the first shielding tape conductor.

4. The multi-pair differential signal transmission cable according to claim 1, wherein a transverse cross-section of the insulator is in a shape of a track including a pair of linear portions and a pair of arc portions located between the linear portions, the linear portions extending in a direction in which the signal line conductors are arranged.

5. The multi-pair differential signal transmission cable according to claim 1, wherein a transverse cross-section of the insulator is in a shape of an ellipse having a major axis and a minor axis orthogonal to the major axis, the major axis extending in a direction in which the signal line conductors are arranged.

6. The multi-pair differential signal transmission cable according to claim 1, wherein the first cable assembly comprises two differential signal transmission cables, and the second cable assembly comprises six differential signal transmission cables.

7. The multi-pair differential signal transmission cable according to claim 1, wherein the covering member comprises a second shielding tape conductor, a braided wire that covers a periphery of the second shielding tape conductor, and a jacket that covers a periphery of the braided wire.

8. The multi-pair differential signal transmission cable according to claim 1, wherein the second intervening member comprises at least one of paper, threads formed by twisting fibrous materials, a foamed material, and a rubber.

9. The multi-pair differential signal transmission cable according to claim 1, wherein the second intervening member comprises a pair of intervening members each comprising the second intervening member.

10. The multi-pair differential signal transmission cable according to claim 1, wherein a plurality of intervening members each comprising the second intervening member are disposed inside the first intervening member.

11. The multi-pair differential signal transmission cable according to claim 1, wherein the covering member comprises:

a second shielding tape conductor that encircles the second cable assembly; and a braided wire that is disposed on an outer surface of the second shielding tape conductor.

12. The multi-pair differential signal transmission cable according to claim 1, wherein the insulating tape is disposed on an outer surface of the first shielding tape conductor.

13. The multi-pair differential signal transmission cable according to claim 1, wherein the insulating tape is longitudinally wound around an entirety of the first shielding tape conductor.

14. The multi-pair differential signal transmission cable according to claim 1, wherein the insulating tape is disposed on an outer surface of the overlap portion.

15. The multi-pair differential signal transmission cable according to claim 1, wherein the overlap portion of said each of the differential signal transmission cables faces the covering member and faces away from a center of the multi-pair differential signal transmission cable.

16. The multi-pair differential signal transmission cable according to claim 1, wherein the second intervening member is disposed outside each of the differential signal transmission cables of the first cable assembly.

17. The multi-pair differential signal transmission cable according to claim 1, wherein the second intervening member is entirely disposed outside each of the differential signal transmission cables of the first cable assembly.

18. The multi-pair differential signal transmission cable according to claim 1, wherein the second intervening member and the first cable assembly are entirely disposed inside the first intervening member.

19. The multi-pair differential signal transmission cable according to claim 18, wherein an entirety of the second cable assembly is disposed outside the first intervening member.

20. The multi-pair differential signal transmission cable according to claim 1, wherein the second intervening member is disposed on a side opposite the overlap portion of each of the differential signal transmission cables.

* * * * *